US010260693B1

(12) United States Patent
Shih

(10) Patent No.: US 10,260,693 B1
(45) Date of Patent: Apr. 16, 2019

(54) VEHICLE LAMP LENS

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 15/835,917

(22) Filed: Dec. 8, 2017

(51) Int. Cl.
*F21S 41/20* (2018.01)
*F21S 41/141* (2018.01)
*F21S 41/275* (2018.01)

(52) U.S. Cl.
CPC ..... *F21S 41/141* (2018.01); *F21S 41/275* (2018.01); *F21S 41/285* (2018.01)

(58) Field of Classification Search
CPC ..... F21S 41/141
USPC ..... 362/520, 311.1, 511, 290
See application file for complete search history.

(56) References Cited

U.S. PATENT DOCUMENTS

2012/0250331 A1* 10/2012 De Lamberteire .. F21S 48/1154 362/311.1
2012/0268940 A1* 10/2012 Sahlin ..... G02B 5/045 362/290
2014/0049975 A1* 2/2014 Lee ..... F21V 5/002 362/511
2016/0272107 A1* 9/2016 Kao ..... B60Q 1/0035
2017/0167688 A1* 6/2017 Gloss ..... F21S 43/13

* cited by examiner

*Primary Examiner* — Allyson N Trail
(74) *Attorney, Agent, or Firm* — Muncy, Geissler, Olds & Lowe, P.C.

(57) ABSTRACT

A vehicle lamp lens includes a base wall and a light output wall. The base wall has a light input surface, and a base surface disposed in front of the light input surface, and having a plurality of parabolic base sections. The light output wall extends forwardly from a front end of the base wall, and has an inner surface, an outer surface, and a light output surface connected between front ends of the inner and outer surfaces. The outer surface is formed with a plurality of microstructures disposed proximate to the base wall. Each of the micro structures has a parabolic first surface portion having a first virtual focus. The first virtual focuses of the first surface portions of the microstructures are located at the same point.

6 Claims, 5 Drawing Sheets

VEHICLE LAMP LENS

FIELD

The disclosure relates to a lamp lens, and more particularly to a vehicle lamp lens which is disposed for transmitting a light that is emitted from a light emitting member.

BACKGROUND

A conventional vehicle lamp includes a light emitting member, and a vehicle lamp lens disposed to transmit light that is emitted from the light emitting member. The vehicle lamp lens has a light incident surface, a reflecting surface and a light output surface. With such disposition, the light that enters the conventional vehicle lamp lens will exit the conventional vehicle lamp lens through the light output surface after undergoing a total internal reflection (TIR) by the reflecting surface. In order to acquire a better light transmitting efficiency, it is necessary to improve the disposition of each of the surfaces of the conventional vehicle lamp lens.

SUMMARY

Therefore, the object of the disclosure is to provide a vehicle lamp lens that has an innovative structure, and that has good light transmitting efficiency.

According to the disclosure, the vehicle lamp lens is adapted to transmit light that is emitted from a light emitting member, and includes a base wall and a light output wall. The base wall has a light input surface adapted to face the light emitting member, and centered at an optical axis which is parallel to a front-rear direction, and a base surface centered at the optical axis, disposed in front of the light input surface for reflecting the light which is propagated from the light input surface, and having a plurality of parabolic base sections. The light output wall extends forwardly from a front end of the base wall, cooperates with the base wall to define a lens space, and has an inner surface, an outer surface disposed opposite to the inner surface, and a light output surface connected between front ends of the inner and outer surfaces. The outer surface is formed with a plurality of microstructures disposed proximate to the base wall for reflecting the light, which is reflected from the base surface, toward the light output surface. Each of the microstructures has a parabolic first surface portion having a first virtual focus. The first virtual focuses of the first surface portions of the microstructures are located at the same point.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
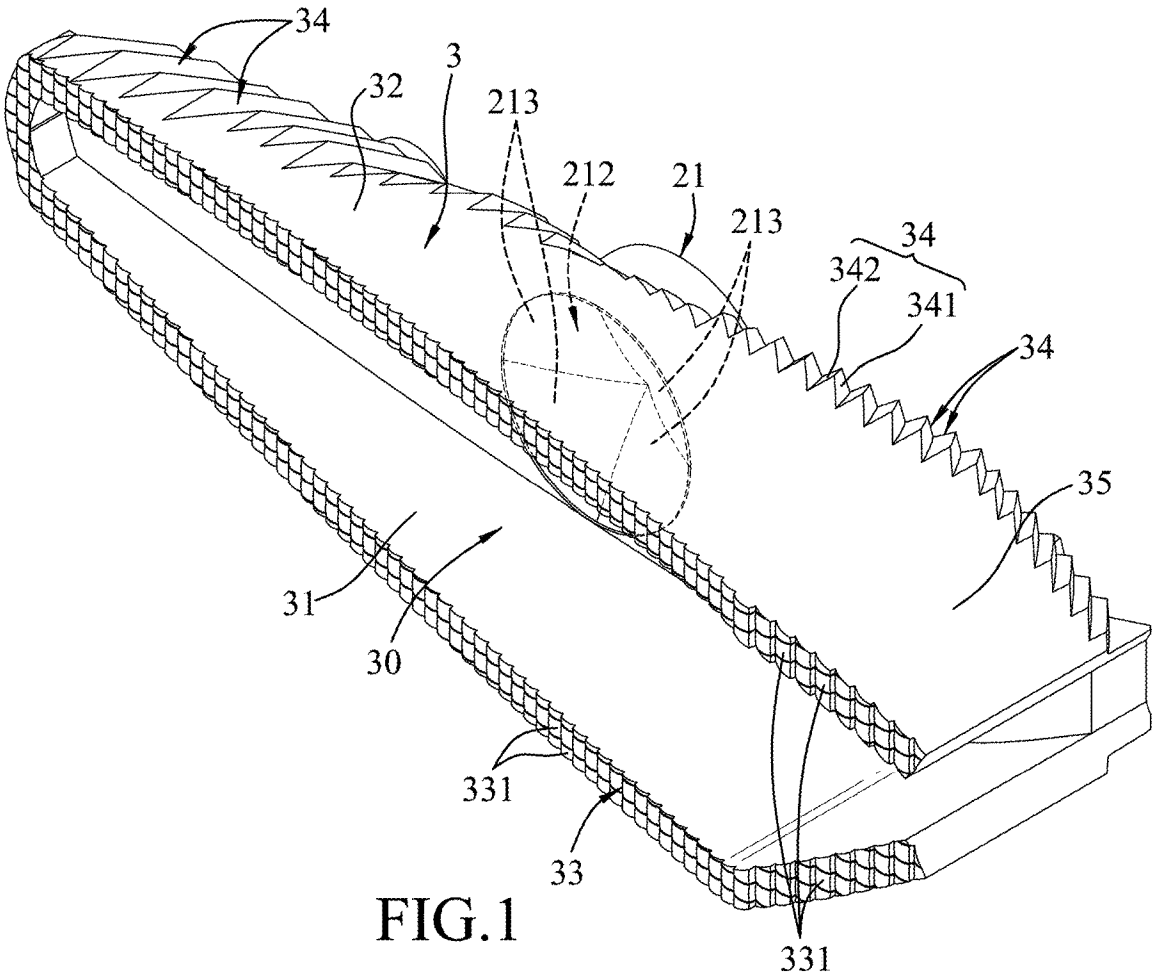
FIG. 1 is a front perspective view of an embodiment of a vehicle lamp lens according to the disclosure.
Figure 2:
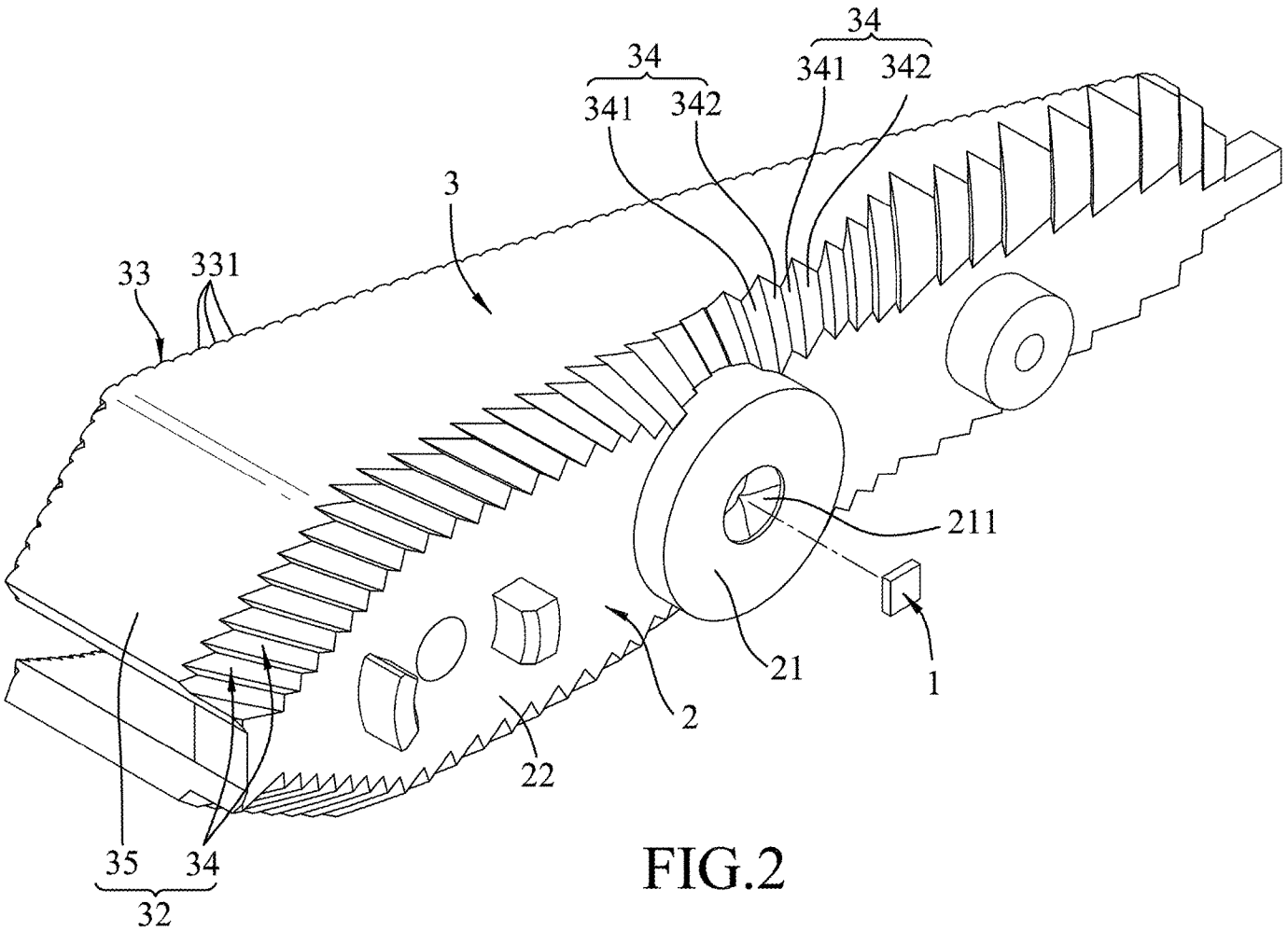
FIG. 2 is a rear perspective view of the embodiment.
Figure 3:
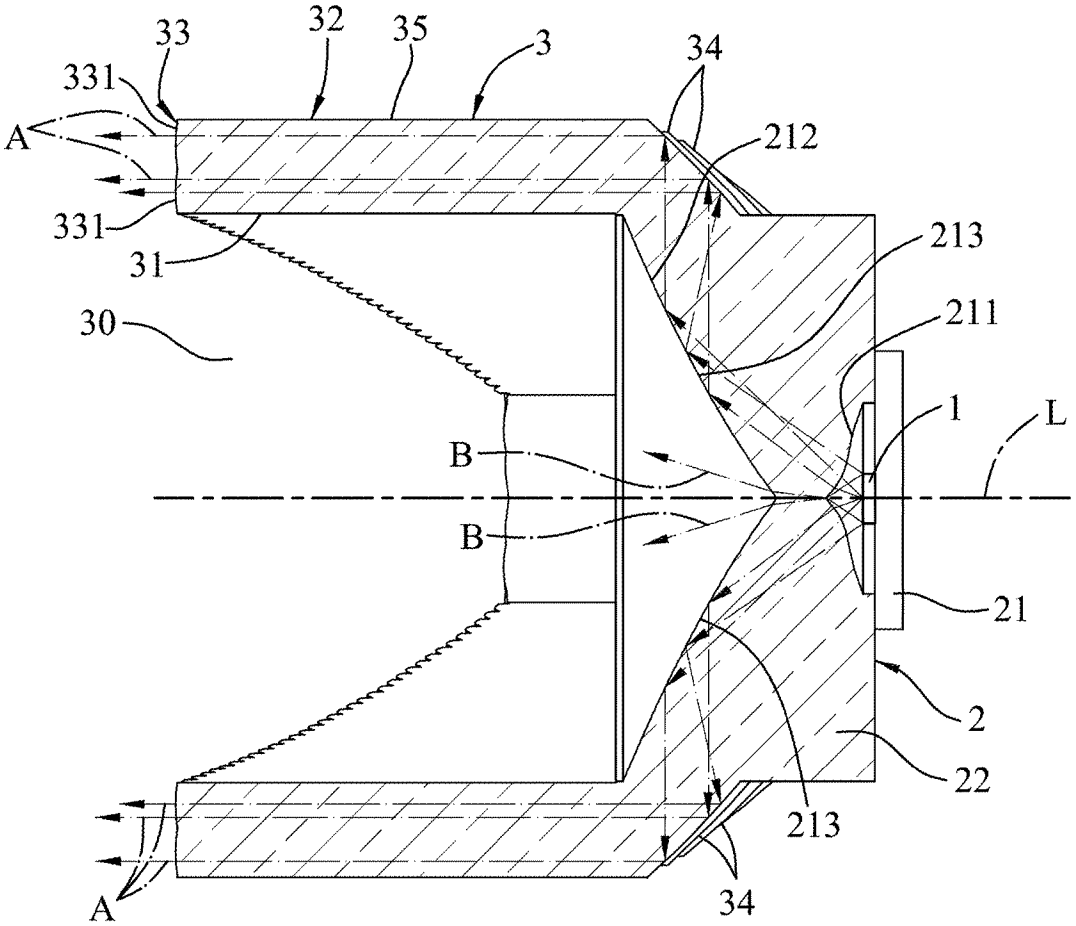
FIG. 3 is a side sectional schematic view of the embodiment, and illustrates light paths.

Referring to FIGS. 1 to 3, the embodiment of a vehicle lamp lens according to the disclosure is adapted to transmit light that is emitted from a light emitting member 1. The light emitting member 1 may be a light-emitting diode (LED). The vehicle lamp lens and the light emitting member 1 cooperately form a vehicle lamp, and may be configured as a head lamp, a daytime running light (DRL), a front turn signal, a rear turn signal and a brake light. The vehicle lamp lens has a base wall 2 and a light output wall 3.

The base wall 2 has a light input portion 21, and an extending portion 22 connected to the light input portion 21. The light input portion 21 has a light input surface 211 adapted to face the light emitting member 1, and centered at an optical axis (L) which is parallel to a front-rear direction, and a base surface 212 centered at the optical axis (L), disposed in front of the light input surface 211. The base surface 212 has a plurality of parabolic base sections 213 disposed for reflecting the light which is propagated from the light input surface 211. It should be noted that, since light beams reflected by a parabolic surface may be parallel to each other, and are further transmitted in a certain direction, in other embodiments, the base sections 213 may cooperate with other types of optical structure to acquire the better light emitting efficiency.

The light output wall 3 extends forwardly from a front end of the base wall 2, and cooperates with the base wall 2 to define a lens space 30.

The light output wall 3 is polygonal-shaped, and has an inner surface 31, an outer surface 32 disposed opposite to the inner surface 31, and a light output surface 33 connected between front ends of the inner and outer surfaces 31, 32. The outer surface 32 is formed with a plurality of microstructures 34 disposed proximate to the base wall 2. The microstructures 34 are juxtaposed along a periphery of a rear end of the outer surface 32, and are disposed for reflecting the light, which is reflected from the base surface 212, toward the light output surface 33. Each of the microstructures 34 has a parabolic first surface portion 341, and a second surface portion 342 connected to the first surface portion 341. The first surface portions 341 cooperately form a multiple parabolic surface structure. The first surface portion 341 of each of the microstructures 34 is connected to the second surface portion 342 of an adjacent one of the microstructures 34. The outer surface 32 has a smooth surface portion 35 disposed in front of the microstructures 34. Where the outer surface 32 is not formed with the microstructures 34 is the smooth surface portion 35. The light output surface 33 is formed with a plurality of diffusing structures 331 protruding forwardly, and disposed for uniforming light passing therethrough. It should be noted that, in other embodiments, the diffusing structures 331 may be omitted.

Figure 4:
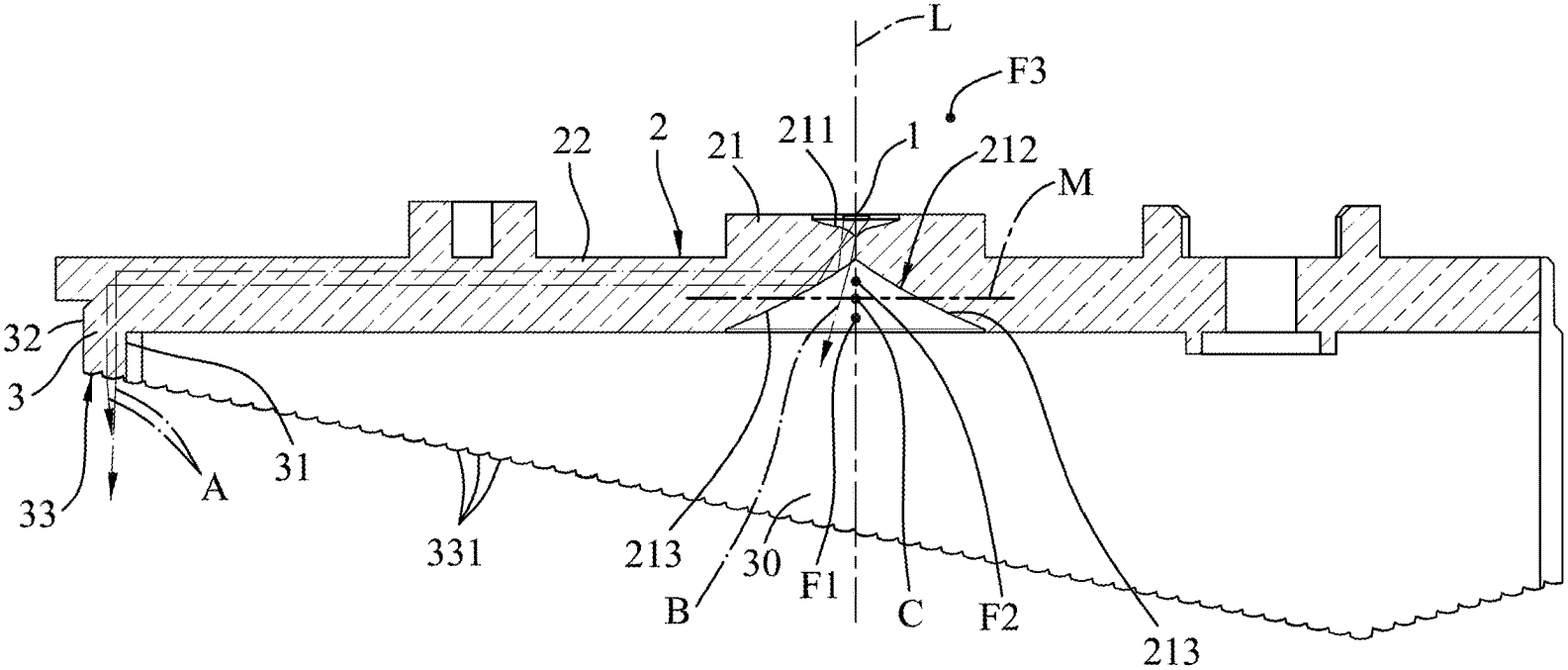
FIG. 4 is a top sectional schematic view of the embodiment, and illustrates light paths.

Referring to FIGS. 1, 3 and 4, the light emitting member 1 is centered at the optical axis (L), and is disposed behind a central portion of the light input surface 211 of the base wall 2. Light beams emitted from the light emitting member 1 firstly enter into the base wall 2 by refraction through the light input surface 211. A majority of light beams (as those transmitted along paths indicated as (A) in FIGS. 3 and 4) is then totally reflected by the base sections 213 of the base surface 212 toward the microstructures 34 of the light output wall 3. The majority of light beams is subsequently reflected by the microstructures 34 to propagate in the light output wall 3, and is finally transmitted out from the light output surface 33. When the majority of light beams is transmitted out from the diffusing structures 331 of the light output wall 3, the majority of light beams can be projected uniformly on the required area. The base surface 212 further has a central portion disposed for allowing the light which is propagated from the light input surface 211 to refract through the base surface 212 and toward the lens space 30. With such disposition, the rest of light beams entering into the base wall 2 by refraction through the light input surface 211 (as those transmitted along paths indicated as (B) in FIGS. 3 and 4) is transmitted into the lens space 30, by refraction through the base surface 212, and propagates forwardly. The light beams which propagate along the paths (A) and the paths (B) cooperately form a light pattern (see FIG. 5) which satisfies the regulations, and which has a special visual effectiveness.

Figure 5:
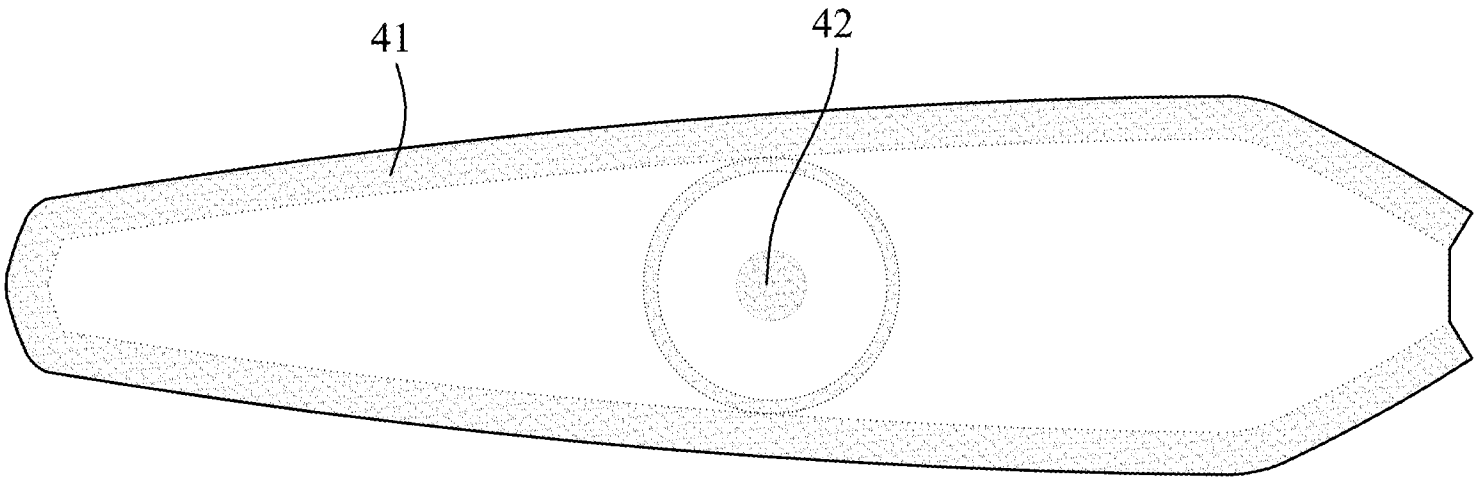
FIG. 5 is a front schematic view of the embodiment, illustrating a light pattern of the embodiment.

Referring to FIGS. 1, 4 and 5, the light pattern has a first area 41 projected by the light beams which propagate along the paths (A), and a second area 42 projected by the light beams which propagate along the path (B), and having a portion that corresponds to the light emitting member 1 in position, and that has brighter visual effectiveness.

Referring to FIGS. 1 and 4, it should be noted that, the first surface portion 341 of each of the microstructures 34 has a first virtual focus and a first focus length. The first virtual focuses of the first surface portions 341 of the microstructures 34 are located at the same point, and the first focus lengths of the first surface portions 241 are different. With such configurations, a better light transmitting efficiency can be assured and the light utilization rate is increased since the first surface portions 341 of the microstructures 34 can reflect the light beams toward the light output surface 33 with a certain angle of reflection so as to prevent the light beams from being transmitted out from the light output wall 3 by refraction through the outer surface 32 of the light output wall 3.

An imaginary line (M) is defined to be perpendicular to the optical axis (L), and intersects with the optical axis (L) at a central point (C) which is located at a midpoint between vertical projection points of front and rear ends of the base surface 212 along the optical axis (L). Preferably, the first virtual focuses of the first surface portions 341 of the microstructures 34 are located on the optical axis (L), and are located between a front limit point which is 1 millimeter in front of the central point (C) (as indicated as virtual focus (F1) in FIG. 4), and a rear limit point which is 1 millimeter behind the central point (C) (as indicated as virtual focus (F2) in FIG. 4). With such configuration, the light transmitting efficiency is also improved.

When the first virtual focuses are located at different points, luminous intensities of different projected areas are also different. From the experiment, when the first virtual focuses are located at the central point (C), the maximum luminous intensity is 3920 candela, when the first virtual focuses are located between the front limit point and the rear limit point, the maximum luminous intensity is 3120 candela, and when the first virtual focuses are located at a position where is not between the front limit point and the rear limit point, the maximum luminous intensity is 1360 candela. It can be concluded that, when the first virtual focuses are located at the central point (C), the vehicle lamp lens has a better light transmitting efficiency.

With the disposition of the parabolic-shaped base sections 213 of the base surface 212, the light beams can be accurately reflected toward the microstructures 34. Each of the base sections 213 has a second virtual focus. The second virtual focuses are located at the same point (as indicated as virtual focus (F3) in FIG. 4), and are farer away from the light input surface 211 than the light emitting member 1. With such configuration, a better light transmitting efficiency can be acquired.

It should be noted that, the light beams can be accurately reflected by the base sections 213 of the light input surface 21 and by the microstructures 34 since the configurations of the base sections 213 and the microstructures 34 need to cooperate with each other. When the second virtual focuses of the base sections 213 are located at the light emitting member 1, or are located at a point which is closer to the light input surface 211 than the light emitting member 1 (i.e., in front of the light emitting member 1), the light input surface 211 and the base surface 212 of the base wall 2 have to be disposed farer from the light emitting member 1 so as to obtain required optical effectiveness. In such manner, the thickness of the base wall 2 in the front-rear direction has to be increased, and such configuration doses not meet the disposition requirement. In contrast, the thickness of the base wall 2 of the vehicle lamp lens of the disclosure can be relatively thin.

From experiment data, the base wall 2 of the vehicle lamp lens of the disclosure can be controlled to be about 5.5 millimeters. However, when the second virtual focuses of the base sections 213 are located at the light emitting member 1, the thickness of the base wall 2 has to be increased to 7 millimeters. When the second virtual focuses of the base sections 213 are located in front of the light emitting member 1, the thickness of the base wall 2 has to be increased to 9.3 millimeters. In addition, the second virtual focuses of the base sections 213 are not preferably located on the optical axis (L). If the second virtual focuses of the base sections 213 are located on the optical axis (L), the light input surface 211 will have to be disposed at the same location as the light emitting member 1, and such disposition is not applicable.

In conclusion, with the disposition of the parabolic-shaped base sections 213 and the parabolic-shaped first surface portions 341 of the microstructures 34, the light beams can be efficiently transmitted in the vehicle lamp lens.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A vehicle lamp lens adapted to transmit light that is emitted from a light emitting member, comprising:

a base wall having a light input surface that is adapted to face the light emitting member, and that is centered at an optical axis which is parallel to a front-rear direction, and a base surface that is centered at the optical axis, that is disposed in front of said light input surface for reflecting the light which is propagated from said light input surface, and that has a plurality of parabolic base sections; and a light output wall extending forwardly from a front end of said base wall, cooperating with said base wall to define a lens space, and having an inner surface, an outer surface that is disposed opposite to said inner surface, and a light output surface that is connected between front ends of said inner and outer surfaces, said outer surface being formed with a plurality of microstructures that are disposed proximate to said base wall for reflecting the light, which is reflected from said base surface, toward said light output surface, each of said microstructures having a parabolic first surface portion that has a first virtual focus, said first virtual focuses of said first surface portions of said microstructures being located at the same point;

wherein an imaginary line is defined to be perpendicular to the optical axis, and intersects with the optical axis at a central point which is located at a midpoint between vertical projection points of front and rear ends of said base surface along the optical axis;

wherein said first virtual focuses of said microstructures are located on the optical axis, and are located between a front limit point which is 1 millimeter in front of said center point, and a rear limit point which is 1 millimeter behind said center point;

wherein each of said base sections of said base surface has a second virtual focus, said second virtual focuses of said base sections being located at the same point, and being farer away from said light input surface than the light emitting member; and wherein said second virtual focuses of said base sections are not located on the optical axis.

2. The vehicle lamp lens as claimed in claim 1, wherein said outer surface of said light output wall has a smooth surface portion disposed in front of said microstructures.

3. The vehicle lamp lens as claimed in claim 1, wherein said base surface of said base wall further has a central portion disposed for allowing the light which is propagated from the light input surface to refract through the base surface and toward said lens space.

4. The vehicle lamp lens as claimed in claim 1, wherein each of said microstructures further has a second surface portion connected to said first surface portion, said first surface portion of each of said microstructures being connected to said second surface portion of an adjacent one of said microstructures.

5. The vehicle lamp lens as claimed in claim 1, wherein said light output wall is polygonal-shaped.

6. The vehicle lamp lens as claimed in claim 1, wherein said light output surface of said light output wall is formed with a plurality of diffusing structures disposed for uniforming light passing therethrough.

* * * * *